United States Patent [19]

Kovit et al.

[11] Patent Number: 4,707,041

[45] Date of Patent: Nov. 17, 1987

[54] SUBSEA WELL ELECTRICAL COUPLING SYSTEM

[75] Inventors: Sheldon L. Kovit; Emil J. Tousek, both of Houston; Larry D. Douglas, Cypress, all of Tex.

[73] Assignee: Hughes Tool Company, Houston, Tex.

[21] Appl. No.: 941,476

[22] Filed: Dec. 15, 1986

[51] Int. Cl.[4] ..... H01R 13/629

[52] U.S. Cl. ..... 439/131; 439/246; 439/374; 439/372

[58] Field of Search ..... 339/15, 34, 35, 64 R, 339/64 M, 65, 75 R, 75 M, 115 R, 115 C, 117 R

[56] References Cited

U.S. PATENT DOCUMENTS

| | | | |
|---|---|---|---|
| 2,724,093 | 11/1955 | Preston | 339/75 M |
| 3,215,970 | 11/1965 | McCulloch | 339/45 |
| 3,345,604 | 10/1967 | Henschen et al. | 339/34 |
| 3,529,276 | 9/1970 | Hennessey, Jr. | 339/45 |
| 3,551,005 | 12/1970 | Brun | 285/10 |
| 3,629,791 | 12/1971 | Normann | 339/75 M |
| 3,635,184 | 1/1972 | Liautaud | 339/75 M |
| 3,658,366 | 4/1972 | Welch, Jr. et al. | 285/24 |
| 3,774,636 | 11/1973 | Arita | 137/615 |
| 4,227,765 | 10/1980 | Neumann et al. | 339/64 R |
| 4,304,452 | 12/1981 | Kiefer | 339/75 M |
| 4,460,156 | 7/1984 | Hazelrigg et al. | 251/149.3 |
| 4,508,404 | 4/1985 | Frawley | 339/75 M |
| 4,586,767 | 5/1986 | Benjamin et al. | 339/75 R |
| 4,630,878 | 12/1986 | Heine et al. | 339/35 |

FOREIGN PATENT DOCUMENTS

| | | | |
|---|---|---|---|
| 484594 | 3/1976 | U.S.S.R. | 339/75 M |

*Primary Examiner*—John McQuade

*Attorney, Agent, or Firm*—James E. Bradley

[57] ABSTRACT

A subsea well electrical coupling engagement system allows control modules in a subsea well platform to be remotely and electrically coupled to each other. Each control module has an electrical housing that extends laterally outward, the housing having at least one coupling on its outer end for inductively coupling with an adjacent module. The housing is mounted flexibly to the control module. A guide shoe located on the platform engages the lower side of the electrical housing to orient it. A latch rod located in each module latches the module in its receptacle. The latch rod when moved downwardly moves a linkage assembly to push the electrical housing outward into an engaged position.

7 Claims, 7 Drawing Figures

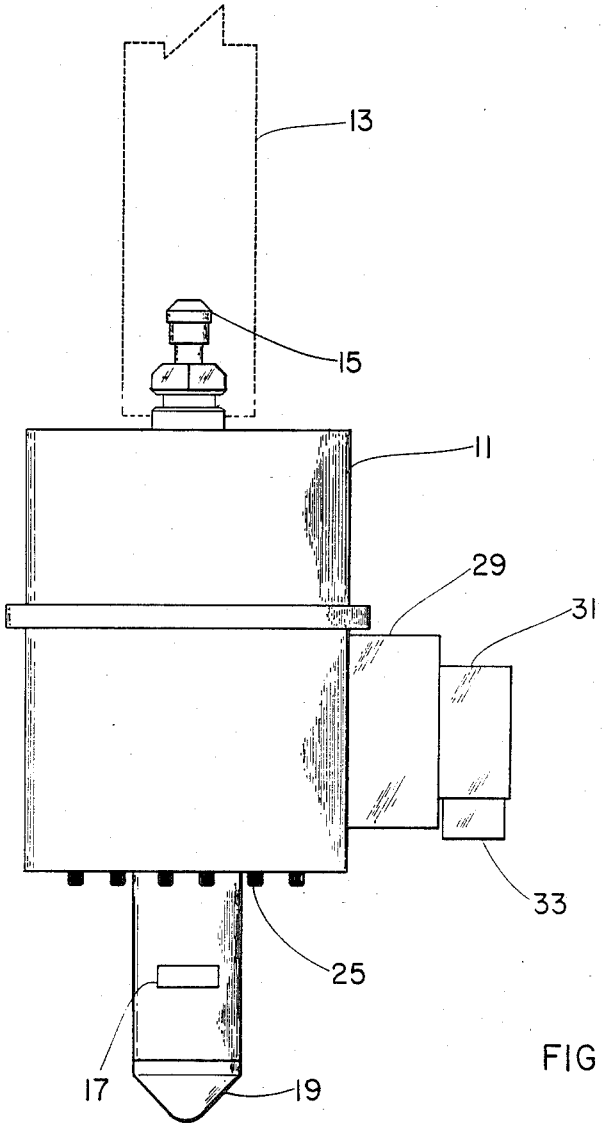
FIG 1
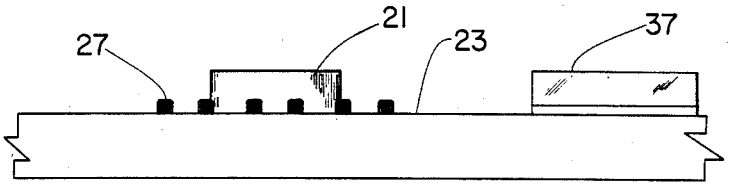

SUBSEA WELL ELECTRICAL COUPLING SYSTEM

BACKGROUND OF THE INVENTION

1. Field of the Invention

This invention relates in general to subsea well electrical couplings, and in particular to means for coupling adjacent control modules or pods electrically.

2. Description of the Prior Art

In offshore oil and gas well development, once a field is discovered, often many production wells will be drilled from the same platform. The platform will be submerged on the sea floor. Each well will have controls and lines leading to a common riser that leads to the surface through which the produced fluids flow. Numerous hydraulic and electrical controls are needed at the subsea platform to remotely control the various wells. Also, electrical communication to the surface is needed for transmitting signals such as monitoring pressure and temperature in the various wells.

The hydraulic and electrical connections are handled by control pods or modules which are lowered from the surface into receptacles located on the platform. The control pods have hydraulic couplings on the lower ends that connect with hydraulic couplings extending through the platform in communication with other control modules and with various wells. The electrical connections are normally through inductive couplings because of the possibility of contamination with the sea water. There is a loss of power in an inductive coupling, consequently the number of such couplings is minimized. As a result, a single umbilical line leading up the riser may extend to one control module, and that control module may electrically communicate with other modules in the control package.

Various means have been employed to communicate electrical power and signals from one control module to another control module. These include electrical couplings mounted on the side of the modules which are moved laterally either mechanically or hydraulically into contact with each other. While such systems have been workable, improvements are desired.

SUMMARY OF THE INVENTION

In this invention, an electrical housing is mounted to the sidewall of each module. The electrical housing has at least one electrical coupling on its outer end for engagement with electrical couplings of adjacent modules. The electrical housing is flexibly mounted to the module to facilitate alignment. A guide means is located on the platform adjacent each module receptacle for receiving the electrical housing of the module as the module locates in the receptacle. The guide means, cooperating with the flexible mounting of the housing, orients the electrical housing for engagement with electrical housings of adjacent modules.

A latch rod extends into each module and is vertically reciprocal for latching each module into its receptacle. A linkage means is connected between the latch rod and the electrical housing in each module for moving the electrical housing outward from the module for engagement with an electrical housing of an adjacent module, in response to the vertical movement of the latch rod. The linkage means includes a plurality of spring-biased rods that allow translational and skewing movement of the face of the coupling for alignment.

BRIEF DESCRIPTION OF THE DRAWING

FIG. 1 is a side view, partially schematic, of a control module having an electrical coupling constructed in accordance with this invention.

DESCRIPTION OF THE PREFERRED EMBODIMENT

Figure 2:
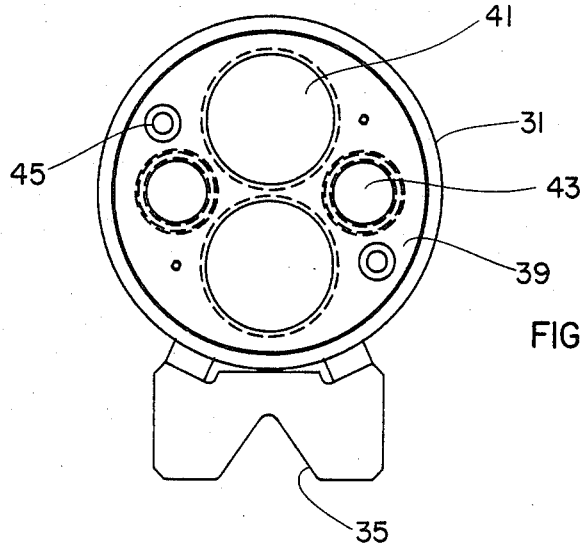
FIG. 2 is an end view of the electrical housing of the control module of FIG. 1.

Referring to FIG. 1, a control module 11 is shown being lowered into position. Control module 11 is a cylindrical pod that is used to make hydraulic and electrical connections at the subsea well. Control module 11 is lowered by a conventional latch tool 13, shown by dotted lines. Latch tool 13 engages a latch rod 15 which extends into the control module 11.

Latch rod 15 is located on the axis of the control module 11 and is vertically reciprocal. Latch rod 15 controls locking dogs 17 located on a stringer 19. When the latch rod 15 is pushed downwardly by the latch tool 13, the locking dogs 17 extend outward from stinger 19 to lock the control module 11 into a receptacle 21. Pulling upwardly on the latch rod 15 retracts the locking dogs 17 to enable the control module 11 to be retrieved for maintenance or other purposes.

The receptacle 21 is located on a platform 23 on the subsea well structure. The control module 11 has a plurality of hydraulic couplings 25 on its lower end. The hydraulic couplings 25 mate with and engage hydraulic couplings 27 formed on the platform 23. Hydraulic couplings 27 are interconnected through internal lines (not shown) with hydraulic couplings on other modules 11.

A cylindrical protective case 29 is rigidly mounted to the sidewall of the control module 11. Case 29 has an axis that is perpendicular to the axis of the control module 11. An outer electrical housing 31 is flexibly mounted in the case 29. The flexible mounting allows the outer electrical housing 31 to flex up, down and sideways.

Figure 3:
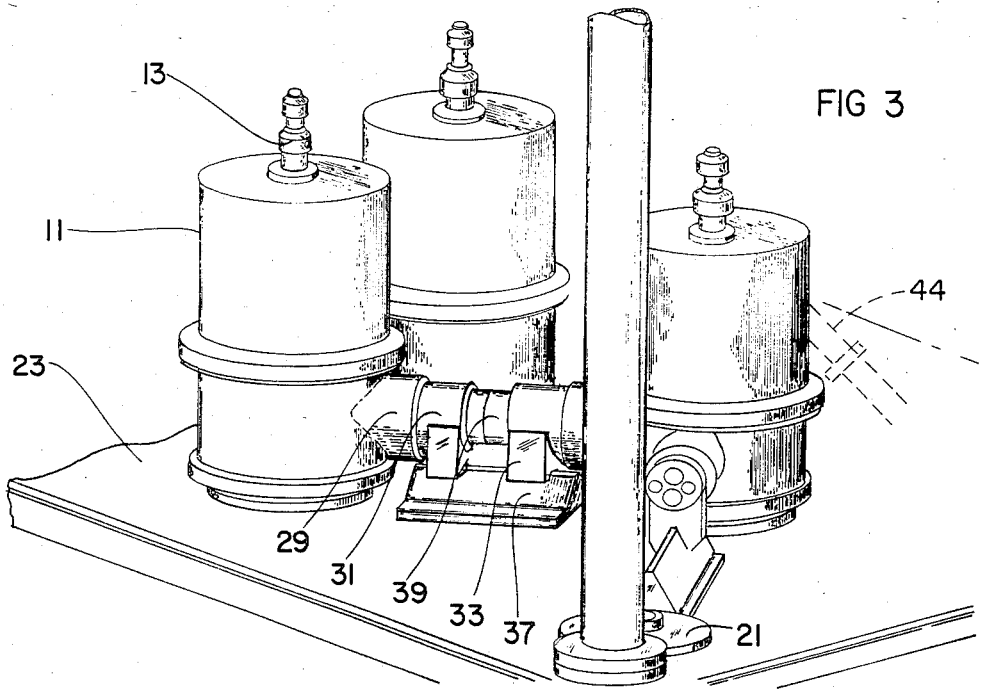
FIG. 3 is a perspective view illustrating three of the control modules, and showing two of them electrically connected to each other.

An upper guide shoe 33 is mounted to the bottom of the electrical outer housing 31. As shown in FIG. 2, the upper guide shoe 33 has a V-shaped bottom 35. The upper guide shoe 33 is adapted to rest on a lower guide shoe 37. Lower guide shoe 37 is shaped in the form of a triangle, as shown in FIG. 3, for engaging the V-shaped bottom 35 of the upper guide shoe 33. The lower guide shoe 37 is mounted to the platform 23 and is located on a radial line extending from the axis of the receptacle 21. The lower guide shoe 37 is positioned to align the electrical outer housing 31 with an electrical housing of an adjacent module 11.

Referring again to FIG. 2, an electrical inner housing 39 is telescopingly carried in the outer housing 31. The inner housing 39 contains two power inductive couplers 41 for communicating power between modules 11. It also contains two signal inductive couplers 43 for communicating signals. The inductive couplers 41 and 43 are conventional, using transformers to transmit the signals and power between the modules 11. One of the modules 11 in the cluster will have an umbilical line 44 that extends to the surface, as shown in FIG. 3. The other modules 11 in the cluster will receive electrical signals and power only from the other modules 11, and will not have an umbilical line to the surface.

As shown in FIG. 2, the electrical inner housing 39 also has an alignment pin 45 that will engage a socket (not shown) in an electrical inner housing 39 of an adjacent module 11 to assure alignment. FIG. 3 shows three control modules 11, with two of them connected electrically with their electrical inner housings 39 extended and in abutment with each other. Another of the modules 11 is shown positioned for alignment with a control module 11 not yet positioned in its receptacle 21.

Figure 4A:
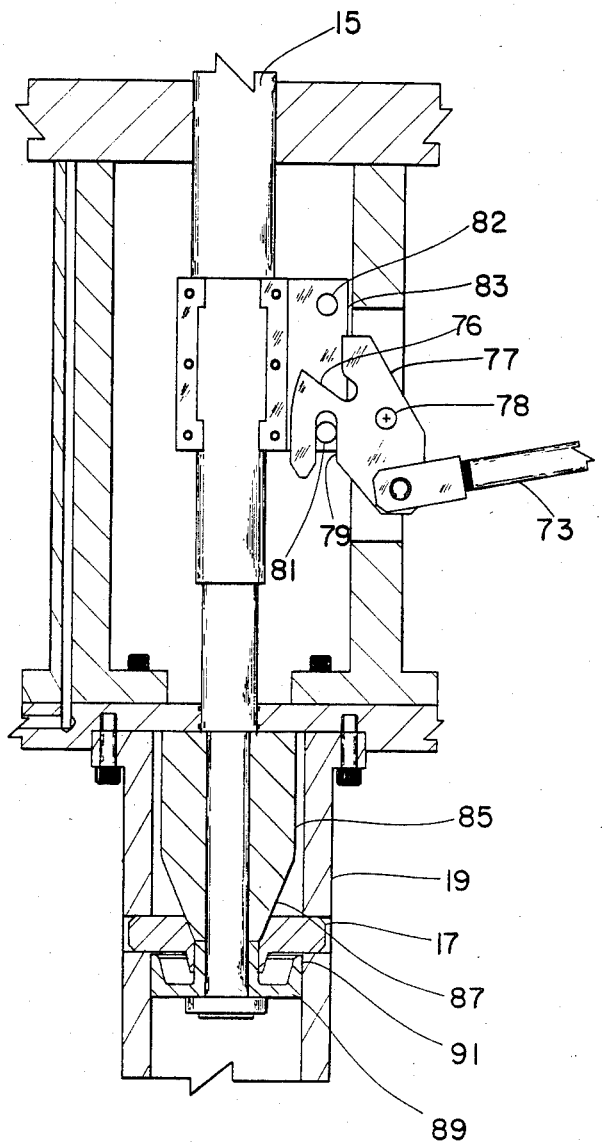
FIG. 4*a* is a vertical sectional view of a portion of the control module of FIG. 1, illustrating the latch rod and linkage lever.
Figure 4B:
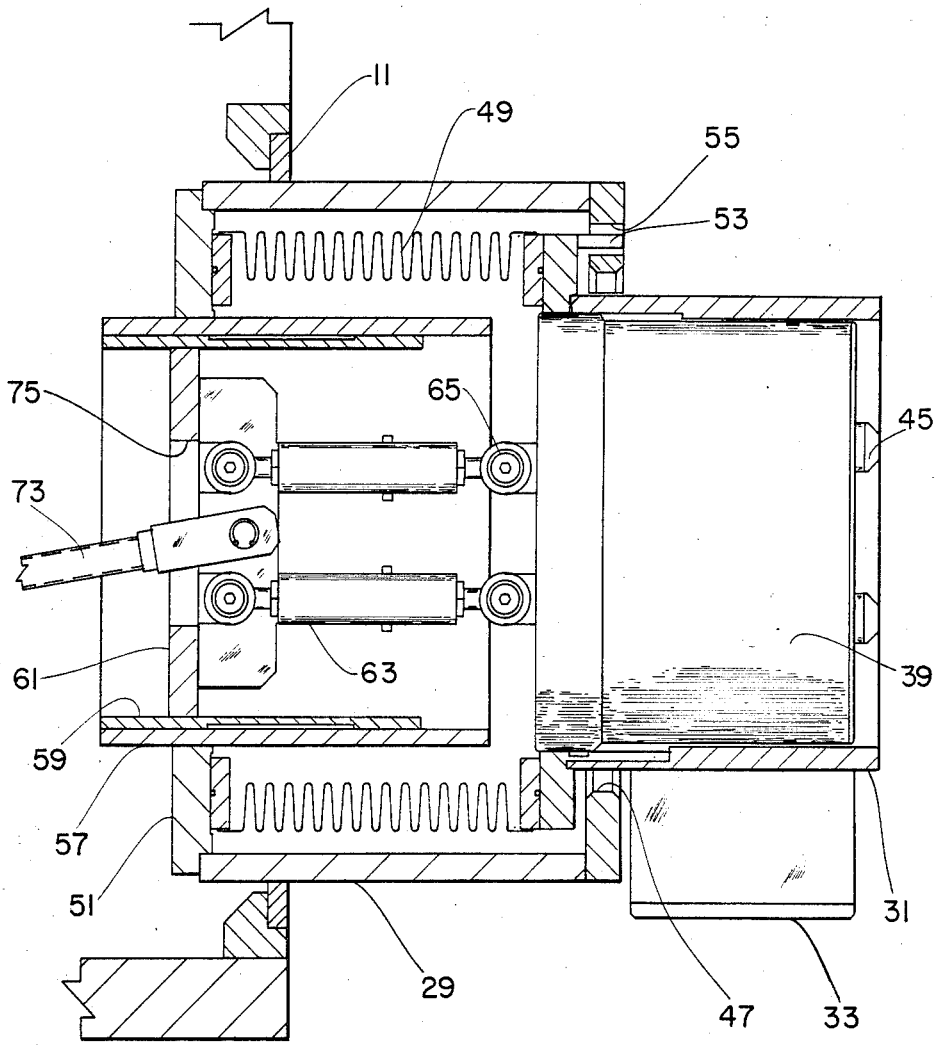
FIG. 4*b* is a vertical sectional view of another portion of the control module of FIG. 1, illustrating the linkage bars and electrical housing.

Referring now to FIG. 4B, the case 29 is a cylindrical member having an outer end containing a large aperture 47. Aperture 47 has a diameter that is a selected amount greater than the outer diameter of the electrical outer housing 31. This clearance allows the outer housing 31 to flex vertically, sideways, and to skew.

A cylindrical metal bellows 49 is connected between the outer housing 31 on one end and an inner wall 51 of the case 29 on the other end. Bellows 49 is filled with oil and seals the interior from sea water admitted through aperture 47. The corrugated sidewall of bellows 49 allows the flexing of the outer housing 31 relative to the case 29. A guide pin 53 extends from outer housing 31 near the front edge of bellows 49. Guide pin 53 locates in an enlarged hole 55 in the outer end of case 29 and limits the degree of the flexing and pivoting of the outer housing 31 in the case 29. Hole 55 is considerably larger than the guide pin 53 to still allow a significant amount of flexing.

Referring still to FIG. 4B, a guide sleeve 57 is rigidly mounted to the inner wall 51 of the case 29. Guide sleeve 57 is a cylinder that extends forwardly into the interior of the bellows 49. An actuating member is carried inside the guide sleeve 57. The actuating member includes an actuating cylinder 59 which has a plate 61 mounted perpendicular to the cylinder 59. The actuating cylinder 59 will move telescopingly inward and outward in the guide sleeve 57.

Figure 5:
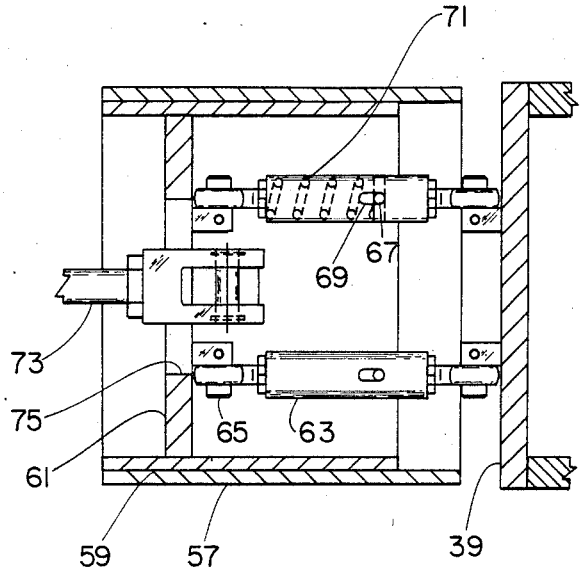
FIG. 5 is a top sectional view of a portion of the electrical housing shown in FIG. 4*b*.

Four linkage bars 63 interconnect the actuating plate 61 with the inner end of the electrical inner housing 39. The linkage bars are evenly spaced apart vertically and horizontally as shown in FIGS. 4B and FIG. 5. Each linkage bar 63 has a pivotal or swivel connection 65 on each end. Each pivotal connection 65 allows vertical, sideways and skewing movement. This allows the outer housing 31 to flex up, down, sideways and to skew relative to case 29 within the constraints of the aperture 47.

The linkage bars 63 transmit lateral movement of the actuating plate 61 to the electrical inner housing 39. The inner housing 39 is slidably and sealingly carried in the outer housing 31. The inner housing 39 moves between a retracted position in the outer housing 31, shown in FIG. 4B, to an extended position shown in FIG. 6.

Each linkage bar 63 has means to allow some overtravel or contraction as the inner housing 39 abuts against an adjacent inner housing 39. The linkage bars 63 will contract when the inner electrical housings 39 are pressed against each other. As shown in FIG. 5, the variance of length of each linkage bar 63 is handled by pin 67 which is connected with one of the pivotal ends 65, with the housing of the linkage bars 63 being connected to the other of the pivotal ends 65. The housing has an elongated slot 69 which allows the pin 67 to travel back and forth. A coil spring 71 urges the pin 67 outwardly, biasing the linkage bar 63 in the extended position. When under a compressive force, pin 67 will travel inwardly in the slot 69, compressing the coil spring 71.

Referring again to FIG. 4B, an actuating rod 73 extends through an aperture 75 in the actuating plate 61. The actuating rod 73 pushes the actuating plate 61 inwardly and outwardly.

As shown in FIG. 4A, actuating lever means is employed to translate vertical movement of the latch rod 15 to horizontal movement of the actuating plate 61 (FIG. 4B). This includes connecting the actuating rod 73 to an actuating lever 77. Lever 77 is a plate pivotally mounted in and to the module 11 by a fixed pivot pin 78. The lever 77 has a lower locking slot 79 and an upper actuating slot 76.

A bracket 83 is mounted to the latch rod 15 for movement therewith. Bracket 83 has an upper actuating pin 82 and a lower locking pin 81 which engage respectively the upper slot 76 and the lower slot 79 of the lever 77. When the inner housing 39 is retracted as shown in FIG. 4B, the lower pin 81 will be located in the lower slot 79, locking the inner housing 39 in this position. As can be seen by comparing FIGS. 4A and 6, when the latch rod 15 moves downwardly, the lower pin 81 moves from the lower slot 79, and the upper pin 82 contacts the upwardly facing surface of upper slot 76. The upwardly facing surface acts as a cam surface, causing the actuating lever 77 to pivot counterclockwise about pin 78. This movement pushes the actuating plate 61 and the inner electrical housing 39 outwardly to the extended position shown in FIG. 6.

The control module 11 locks into the receptacle 21 (FIG. 1) by the structure shown in FIG. 4A. An actuator 85 is mounted to the latch rod 15 for movement therewith. Actuator 85 has a cylindrical upper portion and a conical cam surface 87 on its lower end. When the latch rod 15 is in the upper position shown in FIG. 4A, the locking dogs 17 are retracted and in contact with conical surface 87. When the latch rod 15 is in the lower position, the locking dogs 17 will be in contact with the cylindrical portion of actuator 85. The lever 77 is dimensioned so that the locking dogs 17 will be fully extended, locking the module 11 to receptacle 21 (FIG. 1), before the upper pin 82 contacts the slot 76. The cylindrical portion of actuator 85 slides against the locking dogs 17 and allows farther downward movement of the latch rod 15 after the dogs 17 are fully extended.

A release ring 89 is rigidly mounted to latch rod 15 below actuator 85. Release ring 89 has an upwardly facing lip 91 adapted to engage a depending lip on each locking dog 17. When the latch rod 15 is pulled from its lower position to its upper position, the lip 91 engages the locking dogs 17 and pulls them inwardly to release the module 11 from receptacle 21 (FIG. 1).

In operation, referring to FIG. 1, a control module 11 is lowered by latch tool 13 onto a receptacle 21. As the stinger 19 enters receptacle 21, a slot (not shown) on stinger 19 engages the receptacle 21 and rotates the module 11 upper shoe 33 into coarse alignment with lowr shoe 37. The latch tool 13 moves the latch rod 15 downwardly, causing the locking dogs 17 to extend to lock the control module 11 to the platform 23. Simultaneously, hydraulic connections are made between the hydraulic couplings 25 and 27.

As the module 11 lands on the receptacle 21, the guide shoe 33 engages the guide shoe 37. Adjacent modules 11 will have their electrical housings 39 in the extended positions, but the module 11 being landed will have its electrical housing 39 in the retracted position. The bellows 49, shown in FIG. 4B, allows the electrical outer housing 31 to flex as the guide shoes 33 and 37 engage each other. The linkage bars 63 also accommodate the flexing movement through their pivotal connections 65.

Figure 6:
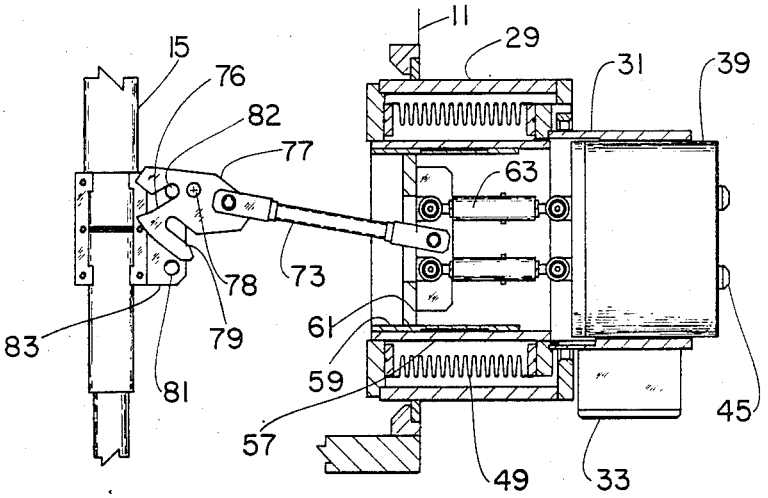
FIG. 6 is a vertical sectional view of part of the control module of FIG. 1, showing the electrical housing in an outer position.

Further downward movement of the latch rod 15 by the latch tool 13 after locking dogs 17 have extended causes the lever 77 to pivot counterclockwise from the retracted position shown in FIG. 4A to the extended position shown in FIG. 6. This causes the actuating plate 61 to move from the inner position shown in FIG. 4B to the outer position shown in FIG. 6.

The lateral movement of plate 61 is transmitted by the linkage bars 63 to the inner electrical housing 39. The inner housing 39 moves outwardly relative to the outer housing 31 and protrudes until it abuts with an inner housing 39 of an adjacent control module 11. The bellows 49 will not extend during the extension of the inner housing 39, because the bellows 49 are connected to the outer housing 31, which flexes, but does not retract and extend. The outward movement of the inner housing 39 is along a radial line of the axis of the control module 11. Once in abutment, any overtravel is accommodated by the contraction of the linkage bars 63 through the coil springs 71, pin 67 and slot 69.

The pivotal connections 65 allow flexing movement in all directions of the inner housing 39 relative to the case 29. Other than contact with the lower guide shoe 37, there is no structure that tends to center the outer housing 31 in the aperture 47 of the case 29. The springs 71 in each linkage bar 63, however, control and limit the skewing of the inner housing 39. For example, if the upper portion of the face of the inner housing 39 contacted an adjacent inner housing prior to its lower portion making contact, the springs 71 in the two upper linkage bars 63 would compress until the lower portion of the inner housing contacted the adjacent inner housing 39. While the upper linkage bars 63 contracted, the lower linkage bars 63 would continue to push the inner housing 39 forwardly, allowing the inner housing 39 to pivot relative to case 29 and align flush with the adjacent inner housing 39.

To retrieve the control module 11, the cycle is reversed. It is not necessary to make any changes to adjacent modules 11, and their electrical inner housings 39 may remain extended. The latch rod 15 is pulled upwardly by a latch tool 13 (FIG. 1). The upward movement of the latch rod 15 immediately rotates the lever 77 (FIG. 4A) clockwise to retract the actuating rod 73 and the inner housing 39. The locking pin 81 will enter the locking slot 79 of the lever 77. Continued upward movement of latch rod 15 causes the lip 89 (FIG. 4A) to retract the locking dogs 17 (FIG. 4A). This allows the control module 11 to be pulled upwardly.

The invention has significant advantages. A control module can be installed and retrieved remotely without changing position of adjacent modules. The flexibility of the electrical housing allows a wide range of tolerances. The guide shoes provide precise alignment to provide a good electrical engagement. The lateral movement of the electrical housing is accomplished mechanically through the same latch rod that latches the module in place. The bellows shield internal components from sea water, but do not require substantial sources of make-up fluid because they do not retract and extend.

While the invention has been shown in only one of its forms, it should be apparent to those skilled in the art that it is not so limited, but is susceptible to various changes without departing from the scope of the invention.

We claim:

1. In a subsea well assembly of the type having a plurality of hydraulic and electrical control modules of the type that are lowered from the surface and latched into receptacles located on a platform on the subsea well assembly, an improved means in each module for transmitting electricity from one module to another, comprising in combination:

an electrical housing extending laterally outward from the module and having at least one electrical coupling on its outer end for engagement with an electrical coupling of an adjacent module;

mounting means for mounting the electrical housing to the module for vertical and horizontal flexible movement relative to the module;

guide means located on the platform adjacent the receptacle for receiving the electrical housing of the module as the module locates in the receptacle, and for orienting the electrical housings of adjacent modules toward each other;

a latch rod extending into the module and being vertically reciprocable for latching the module into its receptacle; and linkage means connected between the latch rod and the electrical housing in the module for moving the electrical housing outward from the module for engagement with an electrical housing of an adjacent module in response to vertical movement of the latch rod.

2. In a subsea will assembly of the type having a plurality of hydraulic and electrical control modules of the type that are lowered from the surface and latched into receptacles located on a platform on the subsea well assembly, an improved means for each module for transmitting electricity from one module to another, comprising in combination:

an electrical housing extending laterally outward from the module and having at least one electrical coupling on its outer end for engagement with an electrical coupling of the adjacent module, the electrical housing protruding from an aperture of the module that is larger in diameter than the electrical housing, providing an annular clearance to allow flexing horizontally and vertically of the electrical housing relative to the module;

guide means located on the platform adjacent the receptacle for receiving the electrical housing of the module as the module locates in the receptacle, and for orienting the electrical housing in alignment with an electrical housing of an adjacent module;

a latch rod extending into the module and being vertically reciprocable for latching the module into its receptacle; and linkage means connected between the latch rod and the electrical housing in the module for moving the electrical housing outward from the module for engagement with an electrical housing of an adjacent module in response to vertical movement of the latch rod, the linkage means including a plurality of linkage bars pivotally connected to the electrical housing and spring means connected with each linkage bar for allowing contraction of each linkage bar.

3. In a subsea well assembly of the type having a plurality of hydraulic and electrical control modules of the type that are lowered from the surface and latched into receptacles located on a platform on the subsea well assembly, an improved means for each module for transmitting electricity from one module to another, comprising in combination:

an electrical outer housing extending laterally outward from the module, the outer housing protruding from an aperture of the module that is larger in diameter than the outer housing, providing an annular clearance to allow horizontal and vertical flexing of the outer housing relative to the module;

an electrical inner housing sealingly and telescopingly received in the outer housing, and having at least one electrical coupling on its outer end for engagement with an electrical coupling on an adjacent module;

a bellows sealingly connecting the outer housing to the module;

guide means located on the platform adjacent the receptacle for receiving the outer housing of the module as the module locates in the receptacle, and for orienting the outer housing of the module toward an outer housing of another module;

a latch rod extending into the module and being vertically reciprocal for latching the module into its receptacle; and linkage means connected between the latch rod and the inner housing of the module for moving the inner housing outward relative to the outer housing into engagement with an inner housing of an adjacent module in response to the vertical movement of the latch rod.

4. In a subsea well assembly of the type having a plurality of hydraulic and electrical control modules of the type that are lowered from the surface and latched into receptacles located on a platform on the subsea well assembly, an improved means for each module for transmitting electricity from one module to another, comprising in combination:

an electrical outer housing extending laterally outward from the module;

an electrical inner housing sealingly and telescopingly received in the outer housing, and having at least one electrical coupling on its outer end for engagement with an electrical coupling on an adjacent module;

a bellows sealingly connecting the outer housing to the module;

a supporting case surrounding the bellows and a portion of the outer housing, the case being rigidly mounted to the module and being of a selected dimension greater than the outer housing to allow the outer housing to move vertically and horizontally relative to the case;

guide means located on the platform adjacent the receptacle for receiving the outer housing of the module as the module locates in the receptacle, and for orienting the outer housing toward an outer housing of an adjacent module; and means contained in the module for moving the inner housing outward relative to the outer housing and into engagement with an inner housing of an adjacent module.

5. In a subsea well assembly of the type having a pair of hydraulic and electrical control modules of the type that are lowered from the surface and latched into receptacles located on a platform on the subsea well assembly, an improved means for each module for transmitting electricity from one module to another, comprising in combination:

an electrical outer housing extending laterally outward from the module;

an electrical inner housing sealingly and telescopingly received in the outer housing, and having at least one electrical coupling on its outer end for engagement with an electrical coupling on an adjacent module;

a bellows sealingly connecting the outer housing to the module;

a supporting case surrounding the bellows and a portion of the outer housing, the case being rigidly mounted to the module and having an aperture through which the outer housing protrudes, the aperture being of a selected dimesion greater than the outer housing to allow translational movement of the outer housing relative to the case;

guide means located on the platform adjacent the receptacle for receiving the outer housing of the module as the module locates in the receptacle, and for orienting the outer housing toward an outer housing of an adjacent module;

a guide sleeve rigidly mounted to the module within the bellows;

an actuating member reciprocally carried in the guide sleeve for lateral sliding movement;

a plurality of linkage bars, each pivotally connected at each end between the actuating member and the electrical inner housing ; and means contained within the module for moving the actuating member inwardly and outwardly in the guide sleeve to selectively cause the inner housing to move inward and outward relative to the outer housing.

6. In a subsea well assembly of the type having a plurality of hydraulic and electrical control modules of the type that are lowered from the surface and latched into receptacles located on a platform on the subsea well assembly, an improved means for each module for transmitting electricity from one module to another, comprising in combination:

an electrical outer housing extending laterally outward from the module;

an electrical inner housing sealingly and telescopingly received in the outer housing, and having at least one electrical coupling on its outer end for engagement with an electrical coupling on an adjacent module;

a bellows sealingly connecting the outer housing to the module;

a supporting case surrounding the bellows and a portion of the outer housing, the case being rigidly mounted to the module and being of a selected dimension greater than the outer housing to allow flexible movement of the outer housing in the case;

guide means located on the platform adjacent the receptacle for receiving the outer housing of the module as the module locates in the receptacle, and for orienting the outer housing toward an outer housing of an adjacent module;

a guide sleeve rigidly mounted to the module within the bellows;

an actuating member reciprocally carried in the guide sleeve for lateral sliding movement;

a plurality of linkage bars pivotally connected at each end between the actuating member and the electrical inner housing;

a latch rod extending into the module and being vertically reciprocal for latching the module into its receptacle;

acutating lever means connected between the latch rod and the actuating member for moving the actuating member outward relative to the guide sleeve as the latch rod moves downward, and for moving the actuating member inward as the latch rod moves upward, to selectively place the inner housings in engaged and disengaged positions.

7. In a subsea well assembly of the type having a plurality of hydraulic and electrical control modules of the type that are lowered from the surface and latched into receptacles located on a platform on the subsea well assembly, an improved means for each module for transmitting electricity from one module to another, comprising in combination:

an electrical housing extending laterally outward from an aperture of the module and having at least one electrical coupling on its outer end for transmitting electricity to an electrical coupling on an adjacent module;

an actuating member carried by the module for inward and outward lateral movement relative to the module;

a plurality of linkage bars spaced apart from each other and pivotally connected at each end between the actuating member and the electrical housing;

spring means in each linkage bar for allowing each linkage bar to contract inwardly and for urging each linkage bar to an extended position;

a latch rod extending into the module and being vertically reciprocal for latching the module into its receptacle; and actuating lever means connected between the latch rod and the actuating member for moving the actuating member outward and thus the linkage bars and the electrical housing outward as the latch rod moves downward, and for moving the actuating member inward as the latch rod moves upward, to retract the electrical housing.

* * * * *